US005936330A

United States Patent [19]

Barbier

[11] Patent Number: 5,936,330

[45] Date of Patent: Aug. 10, 1999

[54] APPARATUS FOR PREVENTING FILAMENT SHORTING IN A MAGNETRON CATHODE

[75] Inventor: Richard L. Barbier, Montgomery, Pa.

[73] Assignee: Litton Systems, Inc., Woodland Hills, Calif.

[21] Appl. No.: 08/925,977

[22] Filed: Sep. 9, 1997

[51] Int. Cl.[6] ..... H01J 1/02; H01J 7/24

[52] U.S. Cl. ..... 313/15; 313/271; 313/272; 313/292; 313/250

[58] Field of Search ..... 313/15, 271, 272, 313/273, 310, 341, 346 R, 292, 250

[56] References Cited

U.S. PATENT DOCUMENTS

| | | | |
|---|---|---|---|
| 2,542,908 | 2/1951 | Derby . | |
| 2,878,415 | 3/1959 | Gormley et al. . | |
| 3,391,298 | 7/1968 | Dorota | 313/271 |
| 3,462,634 | 8/1969 | Blumenberg | 313/271 |
| 4,527,094 | 7/1985 | Gerard et al. . | |
| 4,531,104 | 7/1985 | Schaeffer . | |
| 4,553,066 | 11/1985 | Fields et al. | 313/580 |
| 5,495,145 | 2/1996 | Pingree, Jr. . | |

*Primary Examiner*—Nimeshkumar D. Patel
*Assistant Examiner*—Michael J. Smith
*Attorney, Agent, or Firm*—Graham & James LLP

[57] ABSTRACT

A magnetron includes a cylindrically shaped cathode having an electron emitting surface and a filamentary heater adapted to raise the temperature of the emitting surface sufficient to permit thermionic electron emission therefrom. The filamentary heater comprises a first filament support member having an axial shaft coaxially disposed within the support sleeve and is coupled at an end thereof to a portion of the support sleeve. The first filament support member has a plurality of first tines extending from an opposite end of the axial shaft. A second filament support member has an axial shaft coaxially disposed within the support sleeve along a common axis with the axial shaft of the first filament support member. The second filament support member has a plurality of second tines extending from an end of the axial shaft in substantial alignment with the first tines. A plurality of wire helixes are coupled between the first and second filament support members, with each respective one of the wire helixes being connected between corresponding ones of the first and second tines. A filament spacer is coupled to each of the plurality of wire helixes at a point intermediate the first and second tines. The filament spacer causes the plurality of wire helixes to bow inwardly at the coupling point with the spacer so as to prevent the wire helixes from shorting against the internal surface of the cathode due to the thermal expansion.

16 Claims, 2 Drawing Sheets

FIG. 3
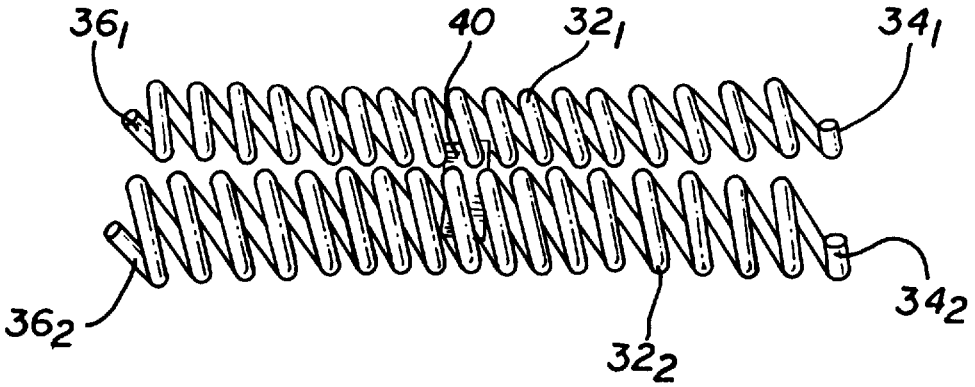
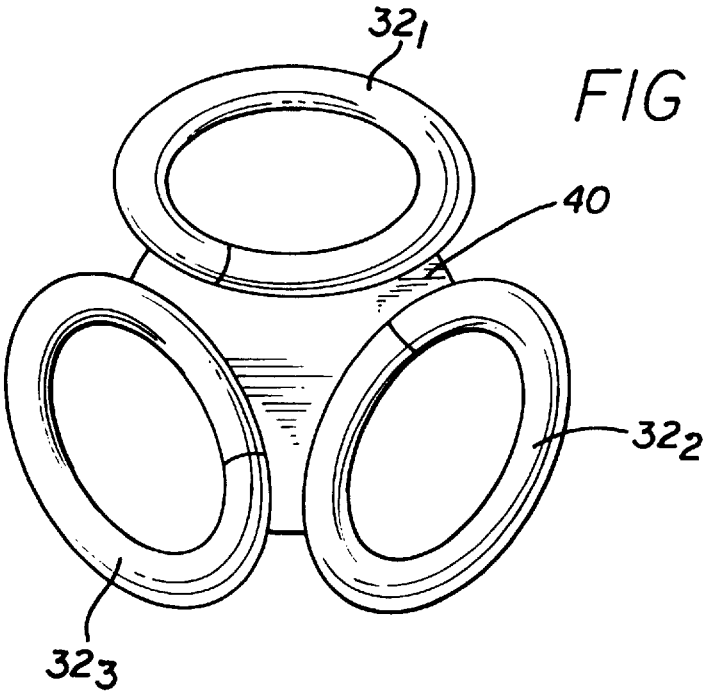
FIG 4
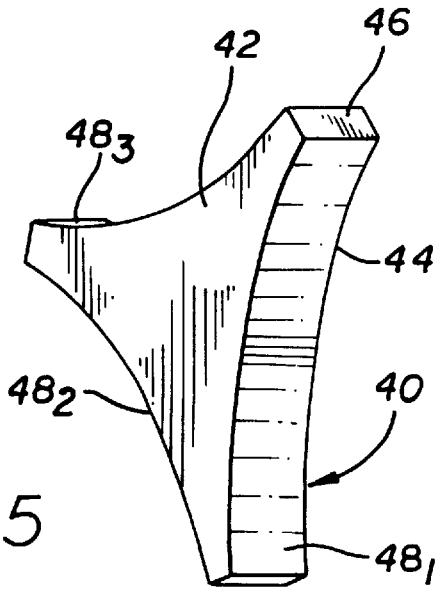
FIG 5

APPARATUS FOR PREVENTING FILAMENT SHORTING IN A MAGNETRON CATHODE

BACKGROUND OF THE INVENTION

1. Field of the Invention

The present invention relates to magnetrons used to generate high power electromagnetic radio frequency (RF) energy, and more particularly, to an apparatus disposed within a magnetron cathode for preventing undesirable physical contact between the heater filament of the cathode and the internal surface of the cathode.

2. Description of Related Art

Magnetrons have been used for many years in electronic systems that require high RF power in the microwave frequency range, such as radar systems. A magnetron typically includes a cylindrically shaped cathode that is coaxially disposed within an anode structure to define an interaction region between the cathode surface and the anode. The anode structure may include a network of vanes which provides a resonant cavity tuned to a frequency of oscillation for the magnetron. The microwave power produced by the magnetron is then coupled into an output waveguide that directs the power into a load, such as an antenna or other device. An example of a magnetron is found in U.S. Pat. No. 5,495,145 for PSEUDO-SPRING LOADING MECHANISM FOR MAGNETRON TUNER, which is incorporated herein by reference.

An internal heater is provided below the surface of the cathode, and is used to heat the cathode surface to a high temperature to produce thermionic emission of electrons therefrom. An electric potential applied between the cathode and the anode provides an electric field across the interaction region which causes the emitted electrons to form into a space-charge cloud. A magnetic field is provided along the cathode axis, perpendicular to the electric field, which causes individual electrons within the electron cloud to spiral into cycloidal paths in orbit around the cathode. When RF fields are present on the anode structure, the rotating electron cloud is concentrated into a spoke-like pattern. This is due to the acceleration and retardation of electrons in regions away from the spokes. The electron bunching induces high RF voltages on the anode structure, and the RF power level build up until the magnetron is drawing peak current for any given operating voltage. Electron current flows through the spokes from the cathode to the anode, producing a high power RF output signal at the desired frequency of oscillation.

In certain types of magnetrons, the internal cathode heater comprises a filament having one or more wire helixes connected in parallel that are rigidly connected at their respective ends. The wire helixes extend roughly the entire length of the cathode. An electrical current conducted through the wire helixes causes heat to be radiated onto the internal surface of the cathode to provide a uniform surface temperature. In some cases, the high filament temperature (e.g., 1,900° C.) causes the wire helixes to expand and bow outwardly. This thermal expansion can cause the wire helixes to contact the internal surface of the cathode and produce an electrical short circuit between the filament and the cathode. The electrical shorting can cause the heater current to bypass a portion of the filament, causing uneven or incomplete heating of the cathode surface. As noted above, the cathode temperature is critical to thermionic electron emission, and improper heating of the cathode will therefore result in a reduction of the electron emission. Moreover, the electrical shorting can also cause excess heater current to be drawn from the magnetron power supply. These effects result in a reduced life expectancy of the magnetron.

Thus, it would be desirable to provide a magnetron cathode having a filament heater in which thermal expansion of the wire helix is controlled to prevent shorting of the wire helix to the internal surface of the cathode.

SUMMARY OF THE INVENTION

In accordance with the teachings of the present invention, an improved cathode filament heater for a magnetron is provided which overcomes the drawbacks of the prior art. The magnetron includes a cylindrically shaped cathode adapted to emit electrons from an emitting surface thereof. The cathode further comprises an axially extending support sleeve that includes the emitting surface. As will be further described below, a spacer prevents shorting between the filament and the internal surface of the cathode emitting surface by controlling the thermal expansion of the filament.

More particularly, the magnetron includes a filamentary heater comprising a first filament support member having an axial shaft coaxially disposed within the support sleeve and is coupled at an end thereof to a portion of the support sleeve. The first filament support member has a plurality of first tines extending from an opposite end of the axial shaft. A second filament support member has an axial shaft coaxially disposed within the support sleeve along a common axis with the axial shaft of the first filament support member. The second filament support member has a plurality of second tines extending from an end of the axial shaft in substantial alignment with the first tines. A plurality of wire helixes are coupled between the first and second filament support members, with each respective one of the wire helixes being connected between corresponding ones of the first and second tines. A filament spacer is coupled to each of the plurality of wire helixes at a point intermediate the first and second tines. The filament spacer is comprised of tungsten, and includes a plurality of concave external surface regions corresponding to each of the plurality of wire helixes. The filament spacer causes the plurality of wire helixes to bow inwardly at the coupling point with the spacer, and thus prevents the wire helixes from shorting against the internal surface of the cathode.

A more complete understanding of the apparatus for preventing filament shorting in a magnetron cathode will be afforded to those skilled in the art, as well as a realization of additional advantages and objects thereof, by a consideration of the following detailed description of the preferred embodiment. Reference will be made to the appended sheets of drawings which will first be described briefly.

BRIEF DESCRIPTION OF THE DRAWINGS

FIG. 3 is a side view of the wire helixes of the heater filament with a filament spacer of the present invention;

FIG. 4 is an end view of the wire helixes; and

FIG. 5 is a perspective view of the filament spacer.

DETAILED DESCRIPTION OF THE PREFERRED EMBODIMENT

The present application satisfies the need for a magnetron cathode having a filament heater in which thermal expansion of the wire helix is controlled to prevent shorting of the wire helix to the internal surface of the cathode. In the detailed description that follows, like element numerals are used to describe like elements illustrated in one or more of the above-described figures.

Figure 1:
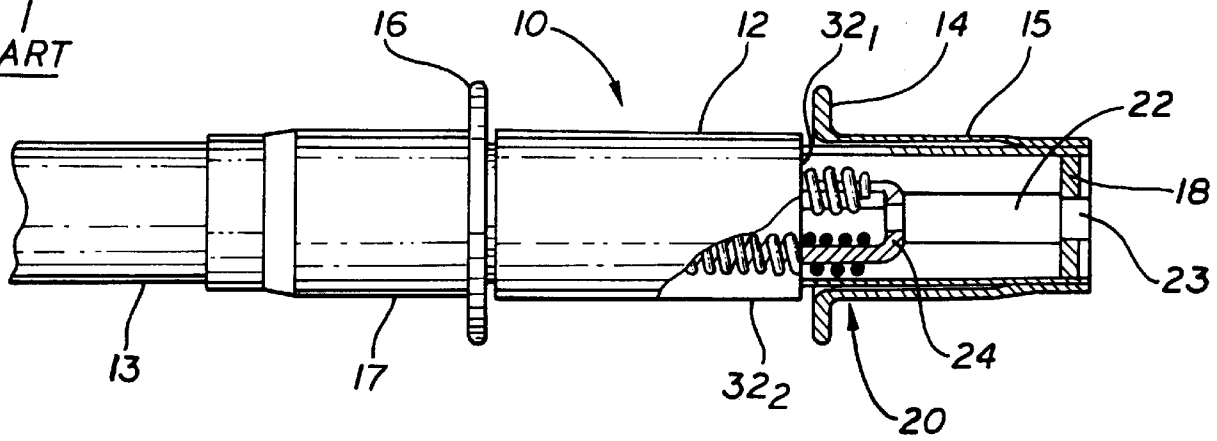
FIG. 1 PRIOR ART
FIG. 1 is a partial sectional side view of a prior art magnetron cathode, showing the cathode heater filament.

Referring first to FIG. 1, a partial sectional side view of a prior art magnetron cathode 10 is shown. As known in the art, the cathode 10 is coaxially disposed with a central axis of the magnetron, and has a cylindrical elongated shape. The cathode 10 comprises a thermionic emitting surface 12 that is concentrically disposed within an anode structure (not shown) of the magnetron. The cathode 10 is operated at a highly negative voltage potential (e.g., −65 kilovolts), which defines an electric field in a cavity between the emitting surface 12 and the anode structure. The emitting surface 12 may be comprised of a generally porous, electron emissive material, such as tungsten impregnated with thorium particles. Cathodes of this general type are also utilized in other electron devices, such as crossed-field amplifiers, and the present invention should not be construed as limited to use within magnetrons.

The cathode 10 further comprises an elongated cathode support sleeve 13 onto which the emitting surface 12 is mounted. The cathode support sleeve 13 provides primary structural and thermal support for the cathode 10. An upper shield 15 encloses a region of the cathode support sleeve 13 above the emitting surface 12, and is coupled to the support sleeve at an end thereof. A first end hat 14 defines a first end of the emitting surface 12 and is provided at a lowermost end of the upper shield 15 opposite from the connection to the cathode support sleeve 13. The upper shield 15 has a diameter slightly larger than a corresponding diameter of the cathode support sleeve 13 to define a coaxial space therebetween, and the upper shield 15 tapers inwardly to the connection point with the cathode support sleeve. Similarly, a lower shield 17 encloses a region of the cathode support sleeve 13 below the emitting surface 12, and is coupled to the support sleeve at an end thereof. A second end hat 16 defines a second end of the emitting surface 12 and is provided at an uppermost end of the lower shield 17 opposite from the connection to the cathode support sleeve 13. The lower shield 17 has a diameter slightly larger than a corresponding diameter of the cathode support sleeve 13 to define a coaxial space therebetween, and the lower shield 17 tapers inwardly to the connection point with the cathode support sleeve. As known in the art, the end hats 14, 16 further act to control the shape of the electric field defined in the magnetron cavity. The cathode support sleeve 13 is coupled to a voltage source at an end thereof (not shown) to provide the negative voltage potential to the emitting surface 12.

Figure 2:
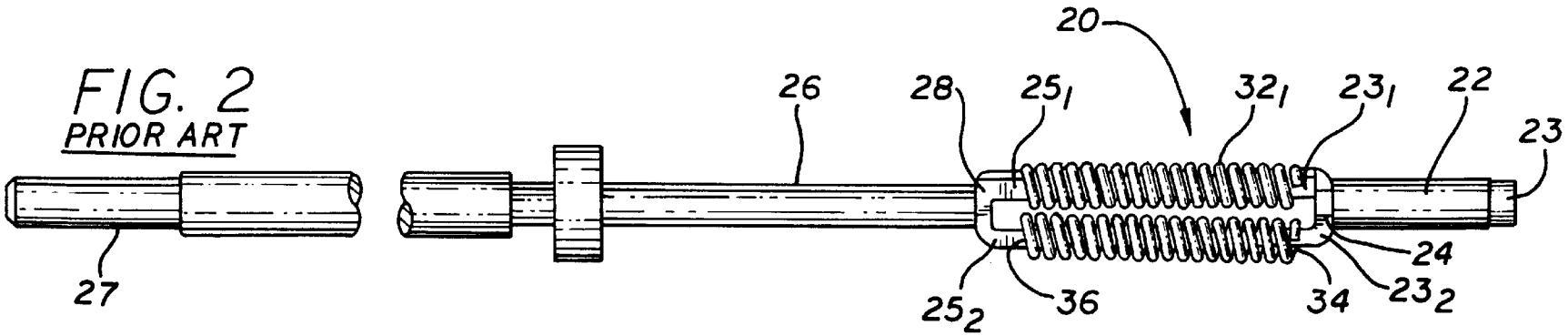
FIG. 2 PRIOR ART
FIG. 2 is a side view of the prior art heater filament.

The emitting surface 12, the cathode support sleeve 13 and the upper shield 15 are partially exposed to show a portion of the cathode filament heater 20, which is also illustrated in greater detail in FIG. 2. The cathode filament heater 20 comprises an upper support member 22 and a lower support member 26 that extend axially along a central axis of the cathode support sleeve 13. The upper and lower support members 22, 26 further comprise cylindrical shafts that act as electrical conductors for the filament heater 20, as will be described below. The upper support member 22 has a stepped end 23 that fixedly engages a washer 18 secured at the upper end of the cathode support sleeve. The lower support member 26 extends to an end 27 that is coupled to a heater voltage source. The upper and lower support members 22, 26 have respective forked ends 24, 28, that are disposed at either side of a space adjacent to the emitting surface 12. The forked ends 24, 28 further include respective tines 23, 25 that are disposed in substantial alignment with each other. While FIGS. 1 and 2 show only two pairs of tines $\mathbf{23_1}$–$\mathbf{23_2}$, $\mathbf{25_1}$–$\mathbf{25_2}$, it should be appreciated that three pairs of tines are included in the preferred embodiment, as will be described in greater detail below.

Each respective pair of tines $\mathbf{23_1}$–$\mathbf{23_2}$, $\mathbf{25_1}$–$\mathbf{25_2}$ carries a respective wire helix $\mathbf{32_1}$–$\mathbf{32_2}$ that extends therebetween. More particularly, a first wire helix $\mathbf{32_1}$ extends between tines $\mathbf{23_1}$, $\mathbf{25_1}$, a second wire helix $\mathbf{32_2}$ extends between tines $\mathbf{23_2}$, $\mathbf{25_2}$, and a third wire helix $\mathbf{32_3}$ extends between the third pair of tines (not shown). The wire helixes $\mathbf{32_1}$–$\mathbf{32_3}$ are comprised of a resistive material that will radiate thermal energy in response to an electrical current, such as tungsten. The wire helixes $\mathbf{32_1}$–$\mathbf{32_3}$ have an oval shape in cross-section (see FIG. 4), and spiral in a coiled manner. The ends of the wire helixes $\mathbf{32_1}$–$\mathbf{32_3}$ wrap around the respective tines $\mathbf{23_1}$–$\mathbf{23_3}$, $\mathbf{25_1}$–$\mathbf{25_3}$, and may be crimped or brazed to the tines to provide a solid electrical connection. An electrical potential applied by the heater voltage source to the end 27 of the lower support member 26 causes current to pass through the three wire helixes $\mathbf{32_1}$–$\mathbf{32_3}$ in parallel, causing the wire helixes to rapidly heat up in order to raise the temperature of the cathode emitting surface 12. The electrical potential provided by the heater voltage source is generally positive with respect to the highly negative voltage potential applied to the cathode 10.

Referring now to FIGS. 3–5, a filament spacer 40 of the present invention is illustrated. The filament spacer 40 comprises an upward facing surface 42, a downward facing surface 44, and a plurality of concave side surfaces $\mathbf{48_1}$–$\mathbf{48_3}$. Each of the concave side surfaces $\mathbf{48_1}$–$\mathbf{48_3}$ has a curvature that corresponds to the oval shape of the wire helixes $\mathbf{32_1}$–$\mathbf{32_3}$, as best illustrated in FIG. 4. The spacing between the concave side surfaces $\mathbf{48_1}$–$\mathbf{48_3}$ is defined by side edges 46. The length of the spacer 40 measured along the central axis of the cathode is relatively small in proportion to the length of the wire helixes $\mathbf{32_1}$–$\mathbf{32_3}$. The spacer is comprised of a material having like thermal characteristics as the wire helixes $\mathbf{32_1}$–$\mathbf{32_3}$, such as tungsten.

The filament 40 is disposed between the three wire helixes $\mathbf{32_1}$–$\mathbf{32_3}$ at a point substantially intermediate their length. The concave side surfaces $\mathbf{48_1}$–$\mathbf{48_3}$ are fixedly attached to the respective wire helixes $\mathbf{32_1}$–$\mathbf{32_3}$, so that the wire helixes cannot bow outwardly with respect to each other as they expand thermally. Moreover, the width of the side edges 46 is selected to ensure that the wire helixes $\mathbf{32_1}$–$\mathbf{32_3}$ actually bow slightly inwardly at the connection point with the spacer 40 and have a slightly smaller diameter at the connection point than at the ends. In a preferred embodiment of the invention, the spacer 40 is brazed to the wire helixes $\mathbf{32_1}$–$\mathbf{32_3}$ using ruthenium powder as a brazing agent, since ruthenium has a melting temperature of approximately 2,600° C. which is substantially above the operative temperature of the filament 20. By using three wire helixes $\mathbf{32_1}$–$\mathbf{32_3}$, it should be appreciated that the thermal expansion force of each one of the wire helixes tends to operate in an opposite direction from, and thus cancels, the thermal expansion forces of the other two wire helixes. As a result, the filament 40 tends to maintain a symetrical structure that extends along the axis defined between the upper and lower support members 22, 26.

It should be appreciated that the filament 20 including the three wire helixes $\mathbf{32_1}$–$\mathbf{32_3}$ acts as parallel resistance circuit. By the addition of the spacer 40, the filament 20 is changed to a series-parallel resistance circuit. Nevertheless, it is anticipated that the resistance of the spacer 40 will have a negligible effect on the total resistance of the filament 20, and will therefore not affect the operation of the filament. It should also be appreciated that a different number of wire helixes wire helixes $32_1$–$32_3$ may be advantageously utilized rather than the three wire helix circuit disclosed, and that the shape of the spacer 40 must then be altered accordingly. To acheive the benefits of symetrical thermal expansion of the filament, however, three or more wire helixes should be utilized.

Having thus described a preferred embodiment of an apparatus for preventing filament shorting in a magnetron cathode, it should be apparent to those skilled in the art that certain advantages of the within system have been achieved. It should also be appreciated that various modifications, adaptations, and alternative embodiments thereof may be made within the scope and spirit of the present invention. The invention is further defined by the following claims.

What is claimed is:

1. A heater for a cylindrically shaped cathode adapted for thermionic electron emission from an emitting surface thereof, the cathode further comprising an axially extending support sleeve that includes said emitting surface, the heater comprising:

a first filament support member disposed within said support sleeve, said first filament support member having a plurality of first tines extending from an end thereof;

a second filament support member disposed within said support sleeve, said second filament support member having a plurality of second tines extending from an end thereof in substantial alignment with said first tines;

a plurality of wire helixes coupled between said first and said second filament support members, each of said plurality of wire helixes being connected correspondingly between said first and second tines; and an electrically conductive filament spacer fixedly attached to each of said plurality of wire helixes at a point intermediate said first and second tines, whereby said spacer precludes outward bowing of said plurality of wire helixes relative to each other caused by thermal expansion of said plurality of wire helixes.

2. The heater of claim 1, wherein said first filament support member further comprises an axial shaft coaxially disposed within said support sleeve.

3. The heater of claim 2, wherein said second filament support member further comprises an axial shaft coaxially disposed within said support sleeve along a common axis with said first filament support member.

4. The heater of claim 1, wherein each one of said plurality of wire helixes further comprises an oval shape.

5. The heater of claim 1, wherein said filament spacer is comprised of tungsten.

6. The heater of claim 1, wherein said filament spacer further comprises a plurality of concave external surface regions corresponding to each of said plurality of wire helixes.

7. The heater of claim 1, wherein said plurality of wire helixes bow inwardly at said coupling point with said filament spacer.

8. The heater of claim 1, wherein said plurality of wire helixes further comprise at least three wire helixes, and said filament spacer further comprises a corresponding number of concave external surface regions coupled to respective ones of said wire helixes.

9. The heater of claim 1, further comprising ruthenium material disposed between said plurality of wire helixes and said filament spacer as a brazing agent.

10. In an electron device having a cylindrically shaped cathode adapted for thermionic electron emission from an emitting surface thereof, the cathode further comprising an axially extending support sleeve that includes said emitting surface, a filamentary heater of the electron device comprises:

a first filament support member having an axial shaft coaxially disposed within said support sleeve and coupled at an end thereof to a portion of said support sleeve, said first filament support member having a plurality of first tines extending from an opposite end of said axial shaft;

a second filament support member having an axial shaft coaxially disposed within said support sleeve along a common axis with said axial shaft of said first filament support member, said second filament support member having a plurality of second tines extending from an end of said axial shaft in substantial alignment with said first tines;

a plurality of wire helixes coupled between said first and said second filament support members, each of said plurality of wire helixes being connected between said corresponding first and second tines; and an electrically conductive filament spacer fixedly attached to each of said plurality of wire helixes at a point intermediate said first and second tines, whereby said spacer precludes outward bowing of said plurality of wire helixes relative to each other caused by thermal expansion of said plurality of wire helixes.

11. The filamentary heater of claim 10, wherein each one of said plurality of wire helixes further comprises an oval shape.

12. The filamentary heater of claim 10, wherein said filament spacer is comprised of tungsten.

13. The filamentary heater of claim 10, wherein said filament spacer further comprises a plurality of concave external surface regions corresponding to each of said plurality of wire helixes.

14. The filamentary heater of claim 10, wherein said plurality of wire helixes bow inwardly at said coupling point with said filament spacer.

15. The filamentary heater of claim 10, wherein said plurality of wire helixes further comprise at least three wire helixes, and said filament spacer further comprises a corresponding number of concave external surface regions coupled to respective ones of said wire helixes.

16. The filamentary heater of claim 10, further comprising ruthenium material disposed between said plurality of wire helixes and said filament spacer as a brazing agent.

* * * * *